US006769484B2

(12) United States Patent
Longmore

(10) Patent No.: US 6,769,484 B2
(45) Date of Patent: Aug. 3, 2004

(54) DOWNHOLE EXPANDABLE BORE LINER-FILTER

(76) Inventor: Jeffrey Longmore, 1447 Davon La., Houston, TX (US) 77058

( * ) Notice: Subject to any disclaimer, the term of this patent is extended or adjusted under 35 U.S.C. 154(b) by 0 days.

(21) Appl. No.: 10/280,358

(22) Filed: Oct. 25, 2002

(65) Prior Publication Data

US 2004/0040703 A1 Mar. 4, 2004

Related U.S. Application Data

(60) Provisional application No. 60/407,760, filed on Sep. 3, 2002.

(51) Int. Cl.[7] ..... E21B 43/08
(52) U.S. Cl. ..... 166/207; 166/227; 166/51
(58) Field of Search ..... 166/227, 51, 207, 166/209, 210, 217, 277, 56, 230, 231

(56) References Cited

U.S. PATENT DOCUMENTS

RE29,447 E * 10/1977 Farrow et al. ..... 210/232
4,200,150 A 4/1980 Saadeh et al.
4,482,086 A * 11/1984 Wagner et al. ..... 277/337
4,506,730 A * 3/1985 McCollin et al. ..... 166/85.1
5,507,345 A * 4/1996 Wehunt et al. ..... 166/285
5,642,781 A * 7/1997 Richard ..... 166/231
5,901,789 A 5/1999 Donnelly et al.
6,012,522 A 1/2000 Donnelly et al.
6,263,972 B1 7/2001 Richard et al.
6,457,518 B1 10/2002 Castano-Mears et al.
6,607,032 B2 * 8/2003 Voll et al. ..... 166/227

* cited by examiner

*Primary Examiner*—Frank Tsay
(74) *Attorney, Agent, or Firm*—Sherman D. Pernia

(57) ABSTRACT

A downhole expandable bore liner and well screen filter assembly has a perforated tubular base-pipe overlain with a self expanding filter-cover. A set of runners or bumpers extends the length of the outside of the filter-cover. A releaseable constriction mechanism holds the liner/filter assembly in a compressed configuration during insertion of the assembly down a well bore to facilitate insertion of the liner/filter assembly into its downhole position. Once positioned downhole in the well bore, the mechanism is released, and the liner/filter assembly takes its expanded or uncompressed configuration and interfaces with the walls of the well bore. In its uncompressed configuration, the liner/filter assembly can contact and press against the walls of the well bore, which contact serves to stabilize the assembly and to center it in the downhole well bore. The resilient and malleable nature of the filter material of the filter-cover can engage and at least partially fill and stabilize the irregularities in the formation wall of the well bore. Additionally, the resilient and malleable nature of the filter material of the filter-cover allows the assembly to utilize an expandable base-pipe in complement with the expandible filter material.

19 Claims, 6 Drawing Sheets

DOWNHOLE EXPANDABLE BORE LINER-FILTER

The present application claims the benefit of prior filed U.S. Provisional Application, serial No. 60/407,760, filed on or about Sep. 3, 2002, to which the present application is a U.S. national utility application.

FIELD OF THE INVENTION

The present invention is in the field of apparatuses and processes particularly adapted for use in an earth fluid well. More specifically, the present invention relates to an apparatus at the end of a well conduit for separating solids from the earth fluids flowing into the conduit, the apparatus comprises a porous mass of adhered filter material.

BACKGROUND OF THE INVENTION

Hydrocarbon producing wells typically are drilled many thousands of feet into the earth in order to reach an oil or natural gas bearing strata. These strata are often structurally weak or fragile geological formations comprising particulate matter, such as sand, gravel and similar materials. Consequently, the downhole formation of the well bore can be subject to degradation and the accumulation of particulates and the migration of these particulates along with the earth fluids into the well.

It is known in the field to use well screens as filters in the downhole bore of a hydrocarbon producing well to prevent the migration of particulates, such as sand, gravel and the like, into the well conduit along with the production flow. Additionally, because the downhole bore can have irregular surfaces, the field has been motivated to develop deformable well screens that are expandable downhole to at least partially set against the surrounding formation and line the borehole. For examples, see U.S. Pat. Nos. 5,901,789 and 6,012,522 to Donnelly et al. and U.S. Pat. No. 6,457,518 to Constano-Mears et al.

Further, at the points of irregularity in the borehole where the rigid, external surface of Donnelly-type well screens does not sufficiently contact the surrounding formation, undesirable gaps and channels can be formed. To reduce or eliminate the effect such formation irregularities, the field has been motivated to develop means to fill and/or support gap forming irregularities. For example, Donnelly et al. disclose the use of resin-coated gravel as a porous fill material which is separately installed in situ as a means for filling gaps between the well bore formation and the well screen.

Because of the benefit of having a downhole well screen installed in close contact with wall of the well bore formation, it would be useful in the field to have alternative downhole expandible well screens that serve not only as a production flow filters, but also as a well bore liners that require less intervention for filling gaps between the well bore formation and the well screen.

SUMMARY OF THE INVENTION

The present invention is a downhole expandable bore liner and well screen filter assembly, particularly for use in a hydrocarbon producing well bore. The liner/filter assembly comprises a perforated tubular base-pipe overlain with a filter-cover. A set of runners (bumpers) extends the length of the outer surface of the assembly. A constriction means holds the liner/filter assembly in a compressed configuration during insertion of the assembly down the well bore. The outside diameter of the liner/filter assembly in its compressed configuration is sufficiently less than the inside diameter of the well bore to facilitate insertion of the liner/filter assembly into its downhole position. Once positioned downhole in the well bore, the constriction means is released, and the liner/filter assembly takes its expanded or uncompressed configuration to interface with the walls of the well bore. In its uncompressed configuration, the liner/filter assembly can contact and press against the walls of the well bore, which contact serves to stabilize the assembly and to center it in the downhole well bore. Additionally, the resilient and malleable nature of the filter material of the filter-cover can engage and at least partially fill and stabilize the irregularities in the formation wall.

The tubular base-pipe is perforated to allow passage of earth liquids ("production flow") from the well bore environment external to the base-pipe into its interior, and further passage into a conduit to which the liner/filter assembly (or string of liner filter assemblies) is attached. The tubular base-pipe has a central axis, a pipe-length, and a tube wall enclosing an interior space. The interior space is disposed to be communicable with the with the fluid space of a well conduit. The tube wall has a plurality of through perforations for passing fluids. Optionally, the tubular base-pipe may be expandable as is known in the field, to provide a tube wall having a plurality of through perforations for passing fluids. For example, see the U.S. Pat. No. 5,901,789 to Donnelly et al. for how to accomplish an expandable base-pipe in the present invention. Typically, the base-pipe will include a connecting means allowing the base-pipe to be joined in series with a well conduit or to another well screen liner/filter assembly. The bottom most liner/filter assembly in a series is plugged at its bottom end.

The filter-cover covers the outer tube-surface of the base-pipe and servers to filter the earth liquids before they pass through the perforations in the tube-wall of the base-pipe. The liner/filter assembly is inserted into the well bore with the filter-cover in a compressed configuration to reduce the overall outside diameter of the assembly to facilitate the insertion process. Once the liner/filter assembly is positioned downhole in the well bore, the filter-cover is allowed to take its normal uncompressed configuration. The filter-cover may be disposed on the outer surface of the base-pipe in any of a numbers of manners practicable in the present invention by one of ordinary skill in the art. For example, the filter cover may be drawn into position over the base-pipe in the manner of a sleeve, or may be wrapped in a helictical fashion over the length of the base-pipe.

The filter-cover is made of a compressible/self-expanding filter material and has a fully compressed-thickness, an expanded-thickness, a fully compressed outer-diameter and an expanded outer-diameter. The filter-cover is made of a filter material impervious to the fluids which it is to filter. In the present invention, the filter-cover comprises a filter material which is substantially impervious to fluids containing hydrocarbons. The filter-cover may comprise one or more layers of filter material, and the different filter material layers may have different physical and/or structural characteristics. For example, the filter-cover may comprises one or more filter materials selected from the group consisting of: a fiber matrix, an open cell foam. Additionally, the different layers of filter materials may have different physical-chemical characteristics and different porosity or filtering characteristics.

Typically, the filter material will have sufficient porosity to pass earth fluids and gas, while filtering out most particulates from the production flow. An appropriate filter material for practice in the present invention in a hydrocarbon producing well is resistant to exposure to crude oil, brine and to other fluids used in producing hydrocarbon wells. Additionally, the filter materials should be resistant to the temperatures, pressure and conditions of pH that may be experienced in hydrocarbon producing wells. The filter material is also mechanically resilient and has sufficient memory to expand to substantially its initial uncompressed condition (thickness) after being bound for a time in a compressed condition. Several polyurethane open-cell foam materials have been found to meet these requirements. It is likely that other materials, such as silicone resin based open-cell foams will also meet these filter material requirements.

A set of runners extend the length of the filter-cover and protrude radially beyond the outer surface of the filter-cover when the liner/filter assembly is in its compressed configuration. The runners are disposed at the outer cover-surface of the filter-cover in a spaced relationship to each other. The space relationship of the runners extends the pipe-length of the base-pipe, and define the overall outer diameter of the liner/filter assembly in its compressed configuration. The runners act as standoffs or bumpers to prevent damage to the filter-cover during insertion of the liner/filter assembly into the well bore. Consequently, the runners are made of an abrasion resistant material such as polyurethane, high density polyurethane, a high-impact plastic, a metal or an appropriate composite material. This facilitates the insertion of the well screen several thousand feet through the abrasive conditions of a well bore without substantial damage to the filter-cover. Suitably abrasion resistant runner-material are selectable by one of skill in the art. Additional examples of suitable runner-material include resin, and fiber reinforced plastic.

The runners of the downhole expandable bore liner and well screen assembly have a substantially parallel spaced relationship to each other and to the pipe-length of the base-pipe. Alternatively, in certain applications, the runners can have a substantially parallel spaced relationship to each other, but a non-parallel relationship to the pipe-length of the base-pipe.

The constriction means holds the runners in spaced relationship to each other, while also holding the filter-cover in a compressed condition. The constriction means are disposed circumferentially around the liner/filter assembly and in a spaced pattern crossing the runners. The constriction means serve, either alone or in combination with the runners, to hold the filter-cover in a compressed configuration. The constriction means are disposed in a spaced pattern sufficient to compress the filter-cover to have an external surface with an outer-diameter at a radial distance from the base-pipe axis which is less than the radial distance of an outer edge of the runners proximate the external surface of the compressed filter-cover.

Once the liner/filter assembly is positioned downhole in the well bore, the constriction means are released. Release of the constriction means allows the filter material to expand and reassume it natural uncompressed condition. In an appropriately constructed liner/filter assembly, the filter-cover will contact the formation wall of the well bore upon resuming its substantially completely uncompressed condition. When contacting the formation wall in its uncompressed condition, the filter-cover stabilizes and tends to center the liner/filter assembly in the downhole well bore.

The constriction means is comprised of a material and disposed in the assembly in a manner to make it susceptible to release. To accomplish a releaseable constriction means several mechanisms are available. Examples include constriction means comprising a fusible link, a mechanical tie assembly, and a dissolvable link. Other releaseable constriction means are selectable by the ordinary skilled artisan.

Electro-chemical mechanisms have been utilized to release the constriction means. In one example, the constriction means comprised aluminum wire tightly wrapped around the runners and compressing the filter-cover. Release of the constricting aluminum wire was accomplished by immersing the assembly in a 10% sodium hydroxide solution and dissolving the aluminum wire. In another example, the assembly was immersed in a brine solution and a d.c. voltage was applied to the aluminum wires and to the steel base-pipe. In this example, the aluminum wires became one electrode (the anode) and the steel base-pipe became the other electrode (the cathode) and on the application of an appropriate voltage across the electrodes, the aluminum wires were dissolved in the brine solution by electrolysis.

Chemically releaseable constriction means can be accomplished by constructing the constriction means from a chemically dissolvable material. In this example, the constriction means holding the filter-cover in a compressed configuration is a plurality of dissolvable links, the links being dissolvable in an appropriate solvent or chemical agent. Once the assembly is in place, the appropriate solvent is dispersed into the downhole environment of the assembly to dissolve the constriction means. Alternatively, the solvent to which the chemically releaseable constriction means is susceptible may already be present or otherwise already available downhole. For example, the selected chemically releaseable constriction means in an appropriate situation may be susceptible to crude oil.

A fusible link type releaseable constriction means is accomplished in the present invention utilizing a fusible electrical wire in communication with an electric current source. The fusible electrical wire is tightly wrapped around the runners, compressing the filter-cover. A pair of electrodes communicate with the fusible electrical wires and provide an electrical current source through the wires. Once the liner/filter assembly in its compressed configuration is positioned downhole in the well bore, an appropriate electrical current is run through the fusible wire via the electrodes and the fusible electrical wires are severed by the current. Upon electrically severing the wire, the constriction means is defeated and the filter material resumes its uncompressed configuration. The electrodes used to carry the electrical current in this example can accomplished by making two or more of the runners out of an electrically conductive material and connecting them to a source of electricity. Using runners as electrodes has the benefit of distributing the fusing current along the entire length of the filter-cover and runners.

A mechanical type releaseable constriction means may be accomplished by a simple mechanical tie assembly in which a series of circumferential cross-ties, each cross-tie having two ends are releaseably connectable together by a removable tie-rod, are disposed along the length of the assembly. The cross-ties are released by withdrawing the tie-rod.

DETAILED DESCRIPTION OF THE INVENTION

Figure 1:
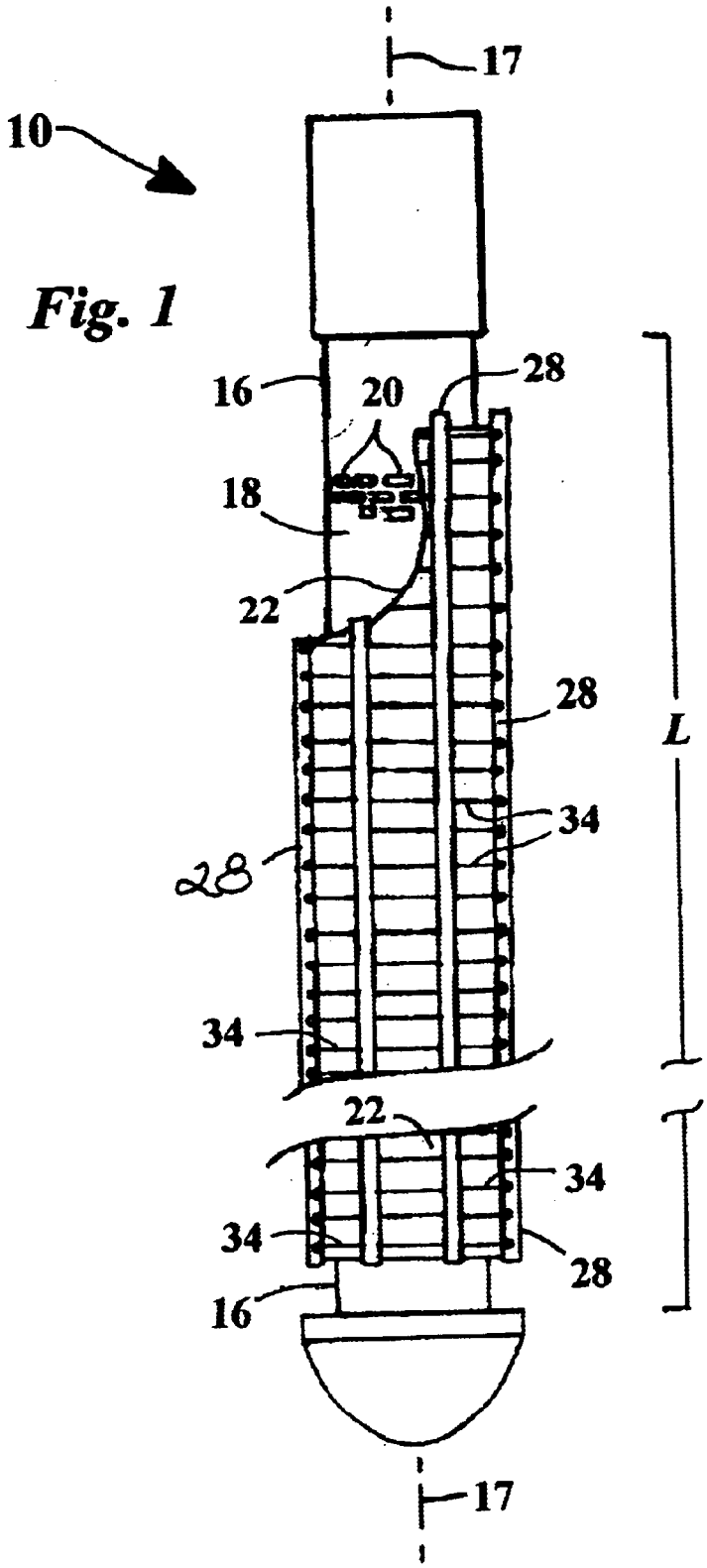
FIG. 1 is a partial cross-sectional view of a linear section of the present downhole expandable bore liner and well screen assembly.

Referring now to the drawings, the details of preferred embodiments of the present invention are graphically and schematically illustrated. Like elements in the drawings are represented by like numbers, and any similar elements are represented by like numbers with a different lower case letter suffix.

As illustrated in FIG. 1, the present invention is a downhole expandable bore liner and well screen filter assembly 10, designed particularly for use in a hydrocarbon producing well bore. The liner/filter assembly 10 comprises a perforated tubular base-pipe 16 overlain with a filter-cover 22. A set of runners (bumpers) 28 extends the length of the filter-cover 22 at the outer surface of the assembly 10. A constriction means 34 holds the liner/filter assembly 10 in a compressed configuration during insertion of the assembly 10 down a well bore 12 (see FIG. 2A). The outside diameter of the liner/filter assembly 10 in its compressed configuration OD-com is sufficiently less than the diameter of the well bore 12 to facilitate insertion of the liner/filter assembly 10 into its downhole position. Once positioned downhole in the well bore 12, the constriction means 34 is released, and the liner/filter assembly 10 takes its expanded or uncompressed configuration OD-ex to interface with the walls of the well bore. In its uncompressed configuration, the liner/filter assembly can contact and press against the walls of the well bore, which contact serves to stabilize the assembly and to center it in the downhole well bore 12. Additionally, the resilient and malleable nature of the filter material of the filter-cover 22 can engage and at least partially fill and stabilize the irregularities in the formation wall of the well bore 12.

Figure 2A:
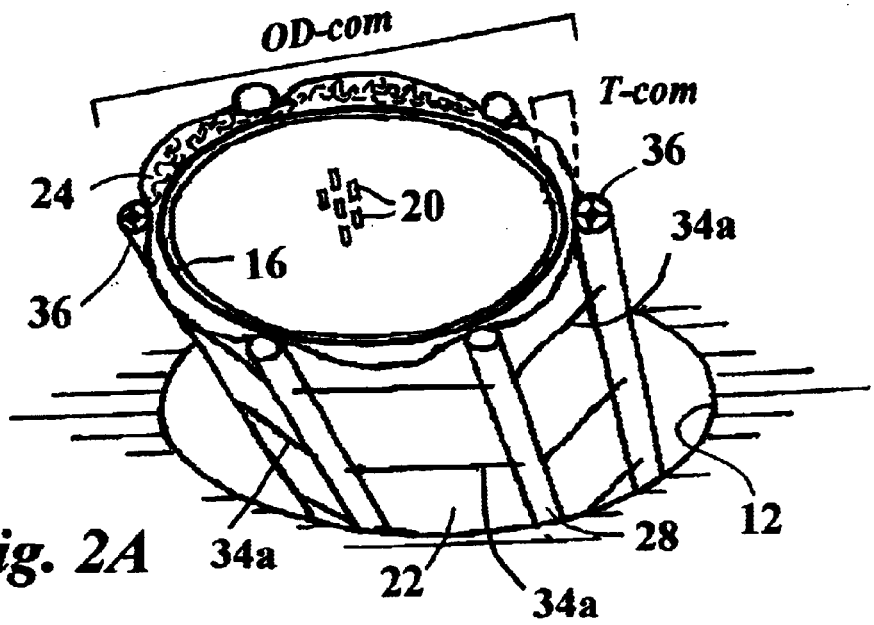
FIG. 2A is a perspective view of the present liner/filter assembly inserted in a well bore in its compressed configuration.
Figure 2B:
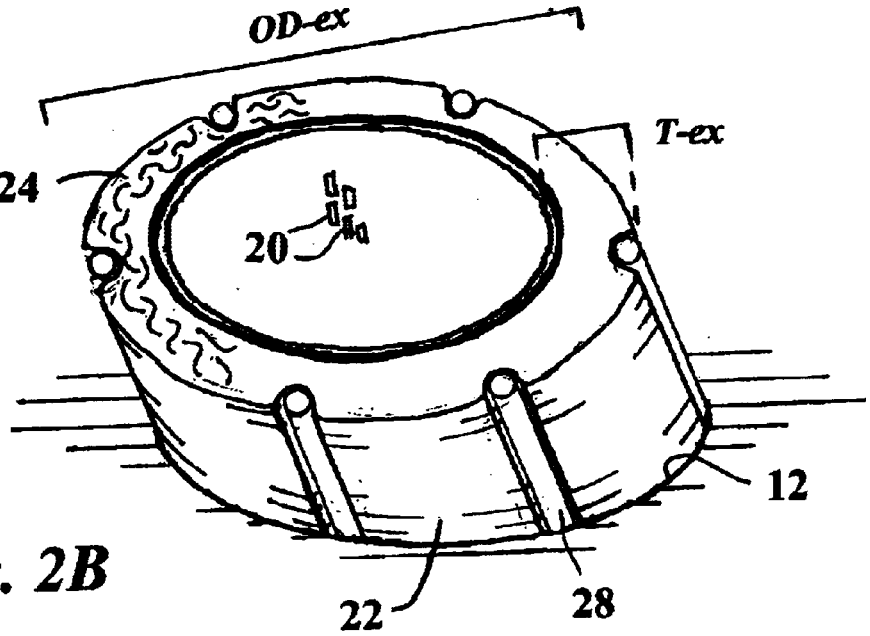
FIG. 2B is a perspective view of the present liner/filter assembly inserted in a well bore in its expanded configuration.

As exemplified in FIGS. 1 and 2A and 2B, the downhole expandable bore liner and well screen assembly 10 comprises a tubular base-pipe 16, the base-pipe having a central axis 17, a pipe-length L and a tube wall 18 with the tube wall having a plurality of through perforations 20 for passing fluids. A filter-cover 22 covers substantially all of the outside surface of the base-pipe tube wall 18. The filter-cover 22 made of a compressible/self-expanding filter material and having a compressed-thickness T-com, an expanded-thickness T-ex, giving the liner/filter assembly 10 a compressed outer-diameter OD-com and an expanded outer-diameter OD-ex. A plurality of runners 28 are disposed around the outside of the filter-cover 22 in a spaced relationship to each other and substantially extending the pipe-length L of the base pipe 16. Constriction means 34 hold the runners 28 in their spaced relationship to each other, and also hold the filter-cover 22 in a compressed condition against the tube wall 18 of the base-pipe 16.

As shown in FIGS. 2A and 2B, the filter-cover 22 is made of a filter material 24 that is impervious to the fluids it is to filter. In a hydrocarbon producing well, the filter material 24 is impervious to fluids containing hydrocarbons and to the other fluids used in producing wells, and to the environmental conditions downhole, such as increased temperature and pressure. The filter materials 24 practicable to provide the filter-cover 22 of the present liner/filter assembly 10 include substantially any porous mass of adhered filter material having the characteristics set forth herein and sufficient compressibility and memory. Examples of suitable filter materials include fiber matrixes, and open cell foams. Other filter materials 24 practicable in the present invention are selectable by the ordinary skilled artisan for practice in the present assembly 10 in view of the figures and teachings herein.

Figure 3:
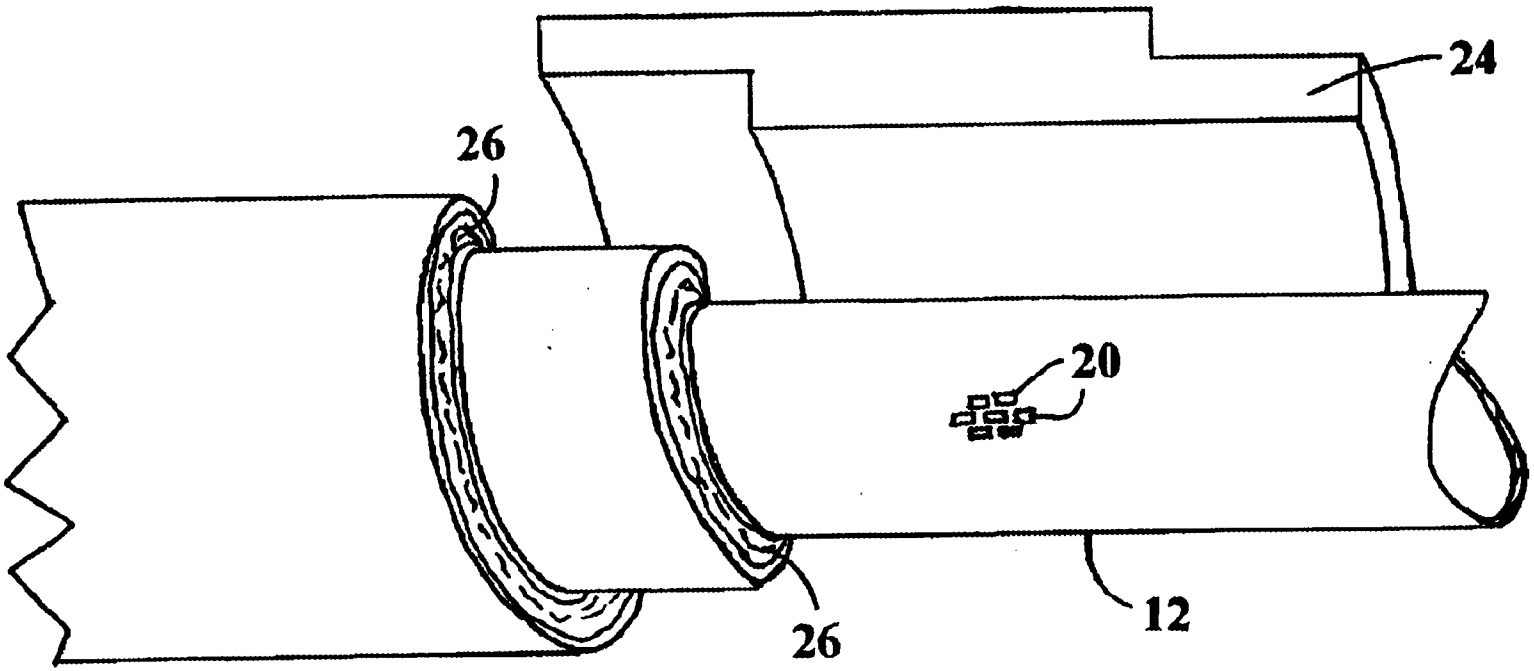
FIG. 3 is a perspective view of a filter-cover of the present liner/filter assembly applied to the base-pipe as an overlapping wrapping of filter material.

The filter-cover 22 may be disposed onto the base-pipe 16 by any of a number of means selectable by one of ordinary skill in the art. In a preferred embodiment as exemplified in FIG. 1, the filter-cover 22 is installed onto the base-pipe 12 as a continuous and seamless sleeve. A benefit of a continuous and seamless cover-filter 22 is the elimination seams which may affect the filtering properties of the filter-cover 22 along the seam. Alternatively, as shown in FIG. 3, the filter-cover 22 may be formed onto the base-pipe 12 by wrapping the base-pipe 12 with one or more overlapping layers of filter material 24. Although only one layer of filter material is shown in FIG. 3, the filter-cover may comprise more than one layer of filter material 24, and the different filter material layers may have different physical and/or structural characteristics, as well as different chemical characteristics and different porosity or filtering characteristics. If the filter cover 22 is to be accomplished in multiple parts or as overlapping layers (as in FIG. 3), it is important to avoid forming radial fluid bypass channels in the filter cover 22. In a preferred embodiment shown in FIG. 3, this is accomplished by the use of an appropriate adhesive 26 along radial joints formed in the overlap of the filter material 24.

A plurality of runners 28 extend the length of the filter-cover 22 and protrude radially beyond the compressed-thickness T-com of the filter-cover 22 when the liner/filter assembly 10 is in its compressed configuration. The runners 28 are disposed at the outer cover-surface of the filter-cover 22 in a spaced relationship to each other. The runners 28 extend the pipe-length L of the base-pipe 12 at least the same extent as the filter cover 22. The runners 28 define the overall outer diameter of the liner/filter assembly 10 in its compressed configuration (see FIG. 2A). The runners 28 act as standoffs or bumpers to prevent damage to the filter-cover 22 during insertion of the liner/filter assembly 10 into the well bore 12. Consequently, the runners 28 are made of an abrasion resistant runner-material such as polyurethane, high density polyurethane, a high-impact plastic, a metal, a plastic, a resin, and/or fiber reinforced plastic.

In the preferred embodiment exemplified in FIG. 1, the runners 28 have a substantially parallel spaced relationship to each other and to the axis 17 of the base pipe. Alternatively, the runners 28 have a substantially parallel spaced relationship to each other and a non-parallel relationship to the axis 17 of the base pipe 12 (not shown). In other words, the runner 28 may spiral down the length L of the liner/filter assembly 10, so long as the configuration of the runners 28 does not interfere with the expansion of the filter-cover 22 upon release of the constriction means 34 (see FIGS. 2A and 2B).

As exemplified in FIGS. 1 and 2A, the constriction means 34 holding the runners 28 in their spaced relationship and also holding the filter-cover 22 at its compressed-thickness T-com are disposed in a spaced pattern sufficiently close together to compress the filter-cover 22 to have an external surface of the compressed outer-diameter OD-com at a radial distance from the base-pipe axis 17 which is less than the radial distance of an outer edge of the runners 28 proximate the external surface of the compressed outer-diameter of the filter-cover 22. The constriction means 34 is comprised of a material and disposed in the assembly 10 in a manner to make the constriction means 34 susceptible to release. To accomplish a releaseable constriction means 34 several mechanisms are available. Examples include constriction means 34 comprising a fusible link, a mechanical tie assembly, and a dissolvable link. Other releaseable constriction means are selectable by the ordinary skilled artisan.

Once the liner/filter assembly 10 of the present invention is positioned downhole in the well bore 12, the constriction means 34 are released. Release of the constriction means 34 allows the filter material 24 of the filter-cover 22 to expand and reassume it natural uncompressed condition. It is intended that the filter-cover 22 of the liner/filter assembly 10 contact the formation wall of the well bore 12 upon filter material 24 resuming its expanded-thickness T-ex in a substantially uncompressed condition. When contacting the formation wall in its uncompressed condition, the filter-cover 22 stabilizes and tends to center the liner/filter assembly 10 in the downhole well bore 12.

To accomplish a releaseable constriction means 34 several mechanisms are available. Examples include constriction means 34 comprising a fusible link, a mechanical tie assembly, an electrolytic link and a chemically dissolvable link. Other releaseable constriction means are selectable by the ordinary skilled artisan.

Electrolytic and chemical mechanisms have been utilized to successfully release the constriction means 34. In one example, the constriction means 34 comprised aluminum wire 34*a* tightly wrapped around the runners 28 and compressing the filter-cover 22 (see FIG. 2A). Release of the constricting aluminum wire 34*a* was accomplished by immersing the assembly 10 in a 10% sodium hydroxide solution and dissolving the aluminum wire 34*a*. In another example, the assembly 10 was immersed in a brine solution and a d.c. voltage was applied via two electrodes 36 to the aluminum wires 34*a* and to the steel base-pipe 16. In this example, the aluminum wires 34*a* became an anode and the steel base-pipe 16 became a cathode, and on the application of an appropriate voltage across the electrodes, the aluminum wires 34*a* were dissolved in the brine solution by electrolysis.

Chemically releaseable constriction means can be accomplished by constructing the constriction means 34 from a chemically dissolvable material. In this example, the constriction means 34 holding the filter-cover in a compressed configuration is a plurality of dissolvable links (not shown) dissolvable in an appropriate solvent or chemical agent. Once the assembly is in place, the appropriate solvent is dispersed into the downhole environment of the assembly 10 to dissolve the constriction means 34.

A fusible link type releaseable constriction means 34 is accomplished in the present invention utilizing a fusible electrical wire 34*a* in communication with an electric current source. The fusible electrical wire 34*a* is tightly wrapped around the runners 28, compressing the filter-cover 22. A pair of electrodes 36 communicate with the fusible electrical wires 34*a* and provide a source to run electrical current through the wires 34*a*. Once the liner/filter assembly 10 in its compressed configuration is positioned downhole in the well bore 12, an appropriate electrical current is run through the fusible wire 34*a* via the electrodes 26 and the fusible electrical wires 34*a* are severed by the current. Upon electrically severing the wire 34*a*, the constriction means 34 is defeated and the filter material 24 resumes its expanded-thickness T-ex in a substantially uncompressed condition. The electrodes 36 used to carry the electrical current in this example is accomplished by making two or more of the runners 28 out of an electrically conductive material and connecting them to a source of electricity. Using runners 28 as electrodes 36 has the benefit of distributing the fusing current along the entire length of the constriction means 34 along the runners 28.

Figure 4:
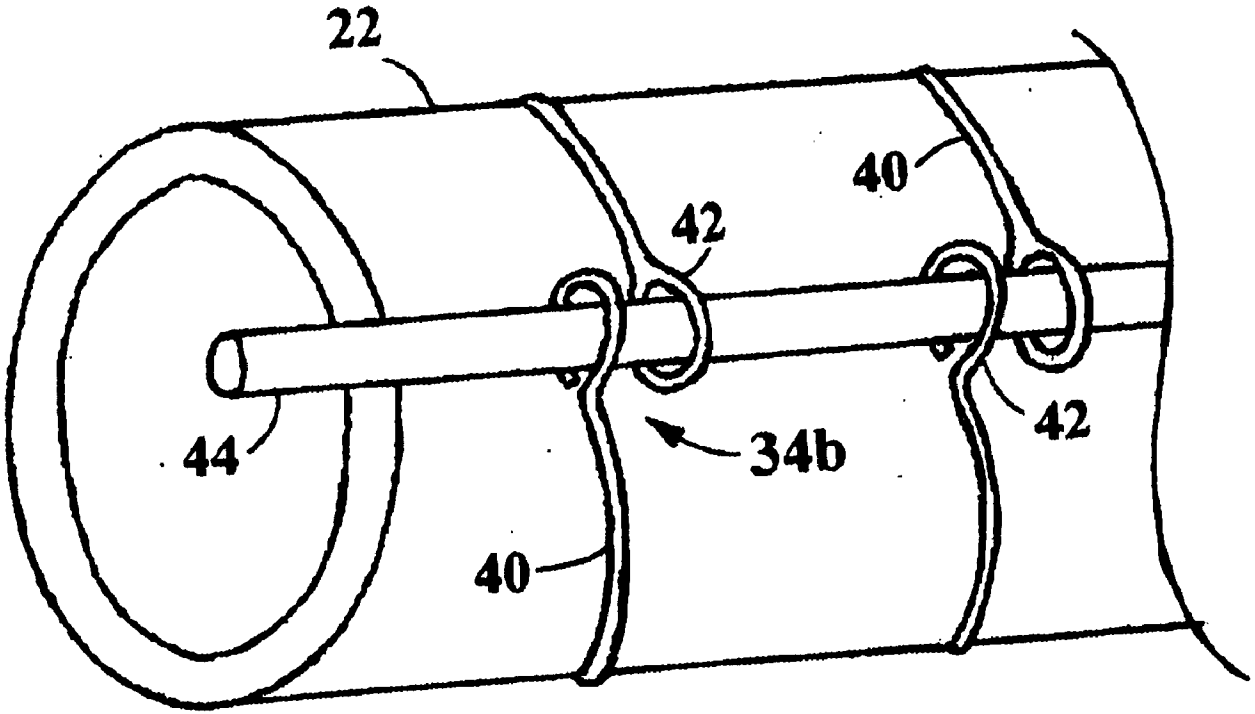
FIG. 4 is a perspective view of a section of the present liner/filter assembly illustrating how a mechanical-type constriction means might appear in the compressed configuration of the liner/filter assembly. For clarity, the base-pipe and runners are not shown.
Figure 5A:
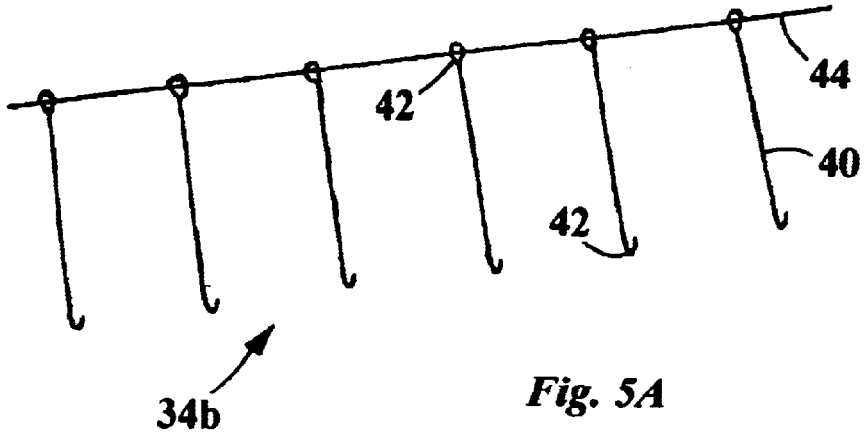
FIG. 5*a* plan view of a mechanical-type constriction means assembly.
Figure 5B:
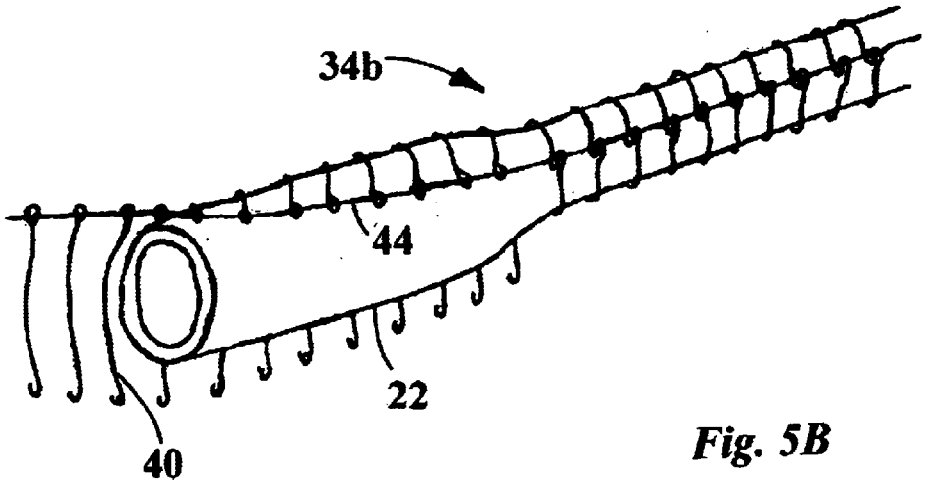
FIG. 5B is a perspective view illustrating the installation of the mechanical-type constriction means assembly of FIG. 4A on a filter-cover of the present liner/filter assembly. For clarity, the base-pipe and runners are not shown.

As exemplified in FIG. 4, a mechanical type releaseable constriction means 34*b* may be accomplished by a simple mechanical tie assembly 38 in which a series of circumferential cross-ties 40, each cross-tie 40 having two rod engaging ends 42 that are releaseably connectable together by a removable tie-rod 44. The cross-ties 40 are disposed along the length of the base-pipe (not shown) outside the runners (not shown). The cross-ties 40 of the constriction means 34*b* are released by withdrawing the tie-rod 44 from the rod engaging ends 42 of the cross ties 40.

Figure 6:
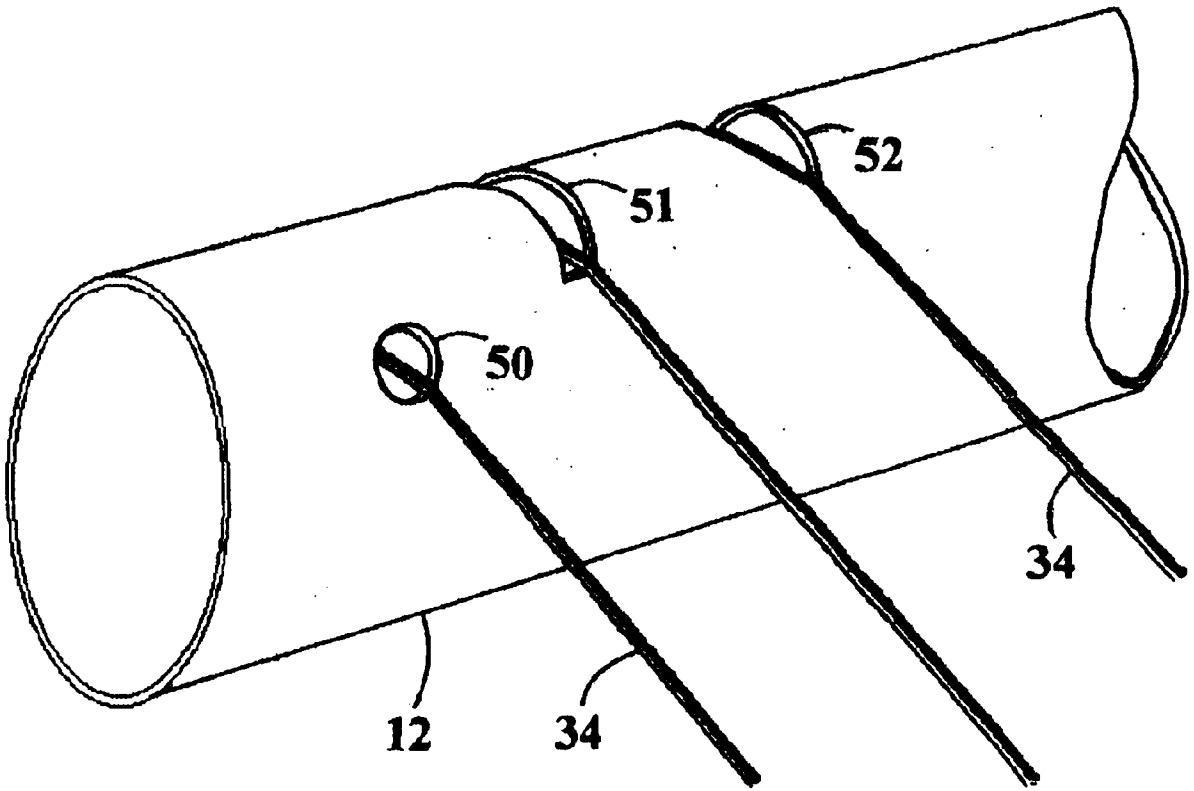
FIG. 6 is a perspective view of a runner and constriction means of the present liner/filter assembly showing the different alternative structural relationships between a wire-type constriction means and the runner.

FIG. 6 illustrate various manners in which a runner 28 can interface with a constriction means 34 of the present liner/filter assembly 10. Shown are different alternative structural features of a runner 28 interfacing with a constriction means 34: an through aperture 50, a notch 51 and a V-groove 52.

In another preferred embodiment, the tubular base-pipe 16 (e.g., see FIG. 1) is expandable as is known in the art. For example, expanding the metal base-pipe to provide a tube wall having a plurality of through perforations for passing fluids is taught in U.S. Pat. Nos. 5,901,789 and 6,012,522 to Donnelly et al. This feature of a preferred embodiment of the present liner/filter assembly 10 is enabled by the filter-cover 22 being made of a filter material 24 that is stretchable to accommodate the expansion of the base-pipe 12.

While the above description contains many specifics, these should not be construed as limitations on the scope of the invention, but rather as exemplifications of one or another preferred embodiment thereof. Many other variations are possible, which would be obvious to one skilled in the art. Accordingly, the scope of the invention should be determined by the scope of the appended claims and their equivalents, and not just by the embodiments.

What is claimed is:

1. A downhole expandable bore liner and well screen assembly comprising:

a tubular base-pipe, the base-pipe having a central axis, a pipe-length and a tube wall with the tube wall having a plurality of through perforations for passing fluids, a filter-cover covering an outside tube-surface of the base-pipe, the filter-cover made of a compressible/self-expanding filter material and having a compressed-thickness, an expanded-thickness, a compressed outer-diameter and an expanded outer-diameter;

a plurality of runners disposed at the outer cover-surface, the runners in a spaced relationship to each other and extending the pipe-length of the base pipe; and constriction means holding the runners in spaced relationship to each other and the filter-cover in a compressed configuration.

2. The downhole expandable bore liner and well screen assembly of claim 1, wherein the tubular base-pipe is expandable to provide a tube wall having a plurality of through perforations for passing fluids.

3. The downhole expandable bore liner and well screen assembly of claim 1, wherein the tubular base-pipe is expandable to provide a tube wall having a plurality of through perforations for passing fluids, and the filter-cover comprises a filter material that is stretchable to accommodate the expansion of the base-pipe.

4. The downhole expandable bore liner and well screen assembly of claim 1, wherein the filter-cover comprises a filter material impervious to the fluids it is to filter.

5. The downhole expandable bore liner and well screen assembly of claim 1, wherein the filter-cover comprises a filter material impervious to fluids containing hydrocarbons.

6. The downhole expandable bore liner and well screen assembly of claim 1, wherein the filter-cover comprises a porous mass of adhered filter material.

7. The downhole expandable bore liner and well screen assembly of claim 1, wherein the filter-cover comprises a filter material selected from the group consisting of: a fiber matrix, and an open cell foam.

8. The downhole expandable bore liner and well screen assembly of claim 1, wherein the runners comprise a runner-material resistant to mechanical damage upon insertion of the assembly into a well bore.

9. The runners of claim 8, wherein the runner-material comprises at least one material selected from the group consisting of: a metal, a plastic, a resin, and fiber reinforced plastic.

10. The downhole expandable bore liner and well screen assembly of claim 1, wherein the runners have a substantially parallel spaced relationship to each other and to the pipe-length of the base pipe.

11. The downhole expandable bore liner and well screen assembly of claim 1, wherein the runners have a substantially parallel spaced relationship to each other and a non-parallel relationship to the pipe-length of the base pipe.

12. The downhole expandable bore liner and well screen assembly of claim 1, wherein the constriction means holding the runners in the spaced relationship and the filter-cover in a compressed configuration are disposed in a spaced pattern to sufficiently compress the filter-cover to have an external surface of the compressed outer-diameter at a radial distance from the base-pipe axis which is less than the radial distance of an outer edge of the runners proximate the external surface of the compressed outer-diameter of the filter-cover.

13. The downhole expandable bore liner and well screen assembly of claim 1, wherein the constriction means holding the runners in the spaced relationship and the filter-cover in a compressed configuration is at least one constriction means selected from the group consisting of: a fusible link, a mechanical tie assembly, and a dissolvable link.

14. The downhole expandable bore liner and well screen assembly of claim 1, wherein the constriction means holding the runners in the spaced relationship and the filter-cover in a compressed configuration is fusible link comprising an electrical conductor in communication with an electric current source.

15. The downhole expandable bore liner and well screen assembly of claim 1, wherein the constriction means holding the runners in the spaced relationship and the filter-cover m a compressed configuration is a mechanical tie assembly having a plurality of cross-ties, each cross-tie having two ends which ends are releaseably connectable together by a removable tie-rod.

16. The downhole expandable bore liner and well screen assembly of claim 1, wherein the constriction means holding the runners in the spaced relationship and the filter-cover in a compressed configuration is a plurality of dissolvable links, the links being dissolvable in an appropriate solvent/chemical agent.

17. The constriction means of claim 16, wherein the dissolvable links are dissolvable in a solvent present in an environment in which the downhole expandable bore liner and well screen assembly is installed.

18. The constriction means of claim 16, wherein the dissolvable links are dissolvable in a solvent added to an environment in which the downhole expandable bore liner and well screen assembly is installed.

19. The downhole expandable bore liner and well screen claim 1, wherein the constriction means holding the runners in the spaced relationship and the filter-cover in a compressed configuration is a metallic wire and electrode combination, the metallic wire dissolvable in an ionic solution by electrolysis.

* * * * *